US008960140B2

(12) United States Patent
Schafer et al.

(10) Patent No.: US 8,960,140 B2
(45) Date of Patent: Feb. 24, 2015

(54) EXTERNAL VOLUME ACCUMULATOR CONFIGURATION IN A CAMSHAFT ADJUSTER

(71) Applicant: Schaeffler Technologies AG & Co. KG, Herzogenaurach (DE)

(72) Inventors: Jens Schafer, Herzogenaurach (DE); Martin Steigerwald, Herzogenaurach (DE); Michael Busse, Herzogenaurach (DE); Jurgen Plate, Gerhardshofen (DE); Andreas Wedel, Emskirchen (DE); Olaf Boese, Nuremberg (DE); Steffen Racklebe, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 126 days.

(21) Appl. No.: 13/744,473

(22) Filed: Jan. 18, 2013

(65) Prior Publication Data

US 2013/0199468 A1 Aug. 8, 2013

(30) Foreign Application Priority Data

Feb. 2, 2012 (DE) ..... 10 2012 201 560

(51) Int. Cl.

| | |
|---|---|
| ***F01L 1/34*** | (2006.01) |
| ***F01L 1/344*** | (2006.01) |
| *F01L 1/047* | (2006.01) |

(52) U.S. Cl.

CPC ..... *F01L 1/3442* (2013.01); *F01L 2001/0475* (2013.01); *F01L 2001/34433* (2013.01); *F01L 2001/34446* (2013.01)

USPC ..... 123/90.17; 123/90.15

(58) Field of Classification Search

CPC ..... F01L 1/344; F01L 1/3442; F01L 2001/34433; F01L 2001/34446

USPC ..... 123/90.15, 90.17, 90.31

See application file for complete search history.

(56) References Cited

U.S. PATENT DOCUMENTS

| | | | | |
|---|---|---|---|---|
| 7,222,597 | B2 * | 5/2007 | Auchter et al. | 123/90.17 |
| 2011/0114047 | A1 * | 5/2011 | Hohmann et al. | 123/90.15 |
| 2011/0197835 | A1 * | 8/2011 | Boegershausen | 123/90.15 |

FOREIGN PATENT DOCUMENTS

| | | |
|---|---|---|
| WO | 2011032805 | 3/2011 |

* cited by examiner

*Primary Examiner* — Zelalem Eshete
(74) *Attorney, Agent, or Firm* — Volpe and Koenig, P.C.

(57) ABSTRACT

A camshaft adjuster (4) including a stator (20) and a rotor (22) which is received in the stator (20) and which can be rotated relative to the stator (20) by a pressure chamber (44), a pressure interface (46, 80) for supplying hydraulic liquid to the pressure chamber (44), and an outflow interface (78) for the discharge of the hydraulic liquid from the pressure chamber (44). The camshaft adjuster (4) also has a third interface (82) for filling the pressure chamber (44) with hydraulic liquid from a volume accumulator (47).

10 Claims, 6 Drawing Sheets

EXTERNAL VOLUME ACCUMULATOR CONFIGURATION IN A CAMSHAFT ADJUSTER

INCORPORATION BY REFERENCE

The following documents are incorporated herein by reference as if fully set forth: German Patent Application No.: 102012201560.4, filed Feb. 2, 2012.

FIELD OF THE INVENTION

The invention relates to a camshaft adjuster and an internal combustion engine with a camshaft adjuster.

BACKGROUND

Camshaft adjusters are technical assemblies for adjusting the phase relationship between a crankshaft and a camshaft in an internal combustion engine.

From WO 2011 032 805 A1, it is known to arrange a volume accumulator in a camshaft adjuster, wherein hydraulic liquid can be drawn from said volume accumulator by the pressure chambers in the event of a negative pressure.

SUMMARY

It is an object of the invention to improve the known camshaft adjusters.

The object is achieved by a camshaft adjuster with one or more features of the invention. Preferred refinements are described below and in the claims.

According to the invention, the volume accumulator for the camshaft adjuster of the type mentioned in the introduction is arranged outside the camshaft adjuster.

The invention is based on the consideration that the volume accumulator is conventionally accommodated in the camshaft adjuster itself. In the case of camshaft adjusters with rotors which have a small axial width of less than 20 mm, it can be difficult to integrate the volume accumulator in the camshaft adjuster without increasing the installation space. The problem is exacerbated if further functional features, for example a locking mechanism, are to be integrated in the rotor. The increase in installation space however adversely affects the camshaft adjuster and drives up system costs. To prevent this, it is proposed that the volume accumulator be formed outside the camshaft adjuster.

For this purpose, it is necessary for the camshaft adjuster to be formed with an additional interface via which the pressure chambers can draw hydraulic liquid from the volume accumulator in the event of a negative pressure. The camshaft adjuster according to the invention thus has three interfaces, wherein the first two interfaces are provided, as is conventional, for the supply and discharge of hydraulic liquid. The negative pressure compensation in the pressure chamber from the externally arranged volume accumulator takes place via the third interface.

The invention therefore provides a camshaft adjuster which comprises a stator and a rotor which is accommodated in the stator and which is mounted such that it can be rotated relative to the stator by means of a pressure chamber. The specified camshaft adjuster also comprises a pressure interface for the supply of a hydraulic liquid to the pressure chamber and an outflow interface for the discharge of the hydraulic liquid from the pressure chamber. According to the invention, the specified camshaft adjuster comprises a third interface for the filling of the pressure chamber with hydraulic liquid from a volume accumulator.

As a result of the possibility of supplying hydraulic liquid to the specified camshaft adjuster from an external volume accumulator, the camshaft adjuster can be of compact and inexpensive design. Furthermore, the volume accumulator itself can be arranged at technically expedient positions at which for example little influence is exerted on the dynamics of the overall system.

In one refinement of the invention, the interface is formed as a rotary transmitter. In this way, the volume accumulator can be formed in a static system, whereby the filled volume accumulator itself generates fewer centrifugal forces which adversely affect the overall system.

In another refinement of the invention, the camshaft adjuster comprises a passage between the third interface and the pressure chamber.

In one particular refinement of the invention, the passage is closed off by a check valve which blocks a flow of hydraulic liquid from the pressure chamber into the interface.

In one particularly preferred refinement, the camshaft adjuster comprises an additional passage between the pressure interface and the pressure chamber, wherein the passage has a larger volume than the additional passage. In this way, the passage between the third interface and the pressure chamber can contribute at least to the volume accumulator, because hydraulic liquid can accumulate already in this passage, which hydraulic liquid can contribute to the negative pressure compensation.

The invention also provides an internal combustion engine comprising a combustion chamber, a crankshaft which is driven by the combustion chamber, and a camshaft which controls the combustion chamber. According to the invention, the internal combustion engine comprises the camshaft adjuster for transmitting rotational energy from the crankshaft to the camshaft, and a volume accumulator for compensation of a negative pressure in the pressure chamber of the camshaft adjuster, wherein the volume accumulator is arranged outside the camshaft adjuster.

In one refinement of the invention, the volume accumulator is formed in the camshaft.

In one particular refinement, a central valve in which the volume accumulator is formed is accommodated in the camshaft.

In another refinement, the arrangement with the camshaft adjuster comprises a cylinder head in which the volume accumulator is arranged.

In yet another refinement, the arrangement with the camshaft adjuster comprises a bearing bridge in which the volume accumulator is arranged.

BRIEF DESCRIPTION OF THE DRAWING

Exemplary embodiments of the invention will be explained below on the basis of a drawing, in which.

DETAILED DESCRIPTION OF THE PREFERRED EMBODIMENTS

Figure 1:
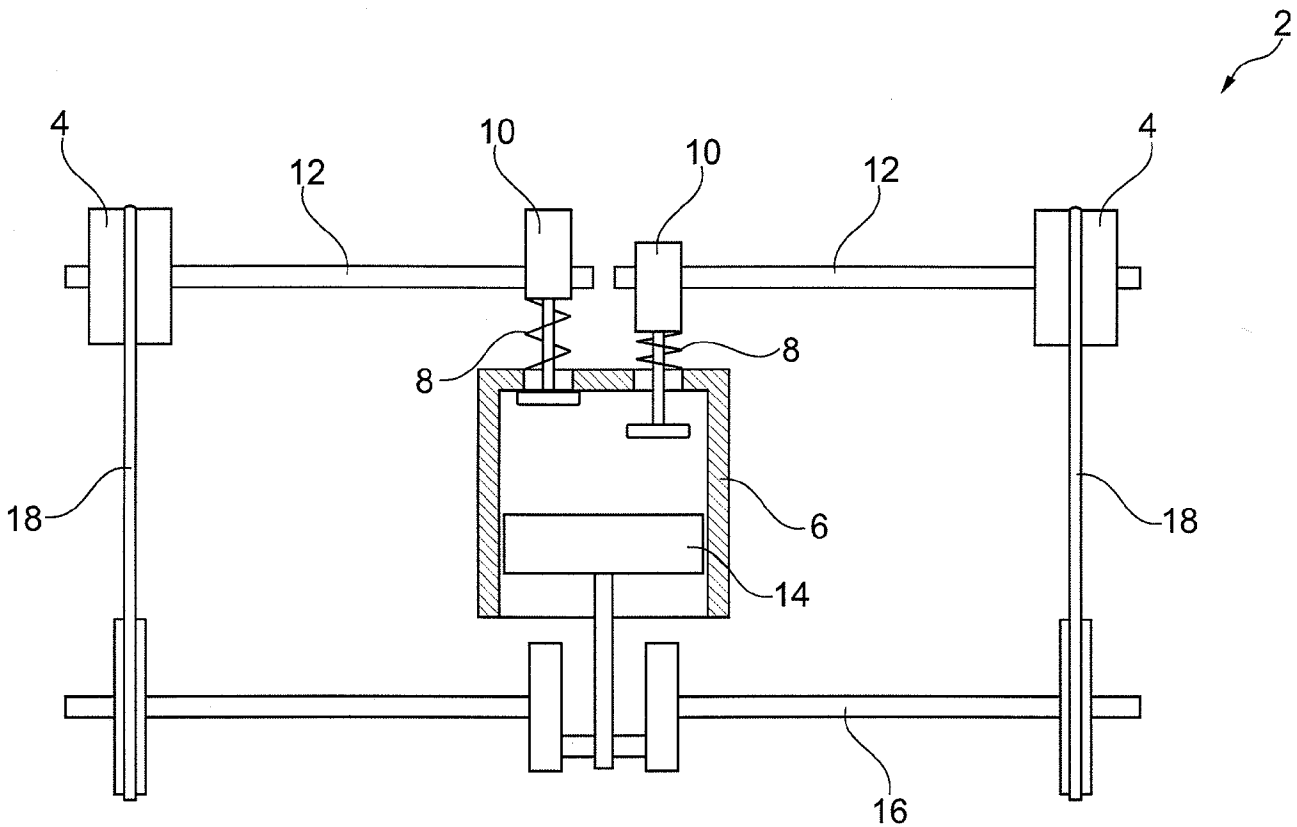
FIG. 1 is a schematic illustration of an internal combustion engine with camshaft adjusters.

In the figures, identical elements are denoted by the same reference numerals and will be described only once.

Reference is made to FIG. 1, which is a schematic illustration of an internal combustion engine 2 with camshaft adjusters 4.

The internal combustion engine 2 comprises, in a manner known per se, a combustion chamber 6 which can be opened and closed by valves 8. The valves are actuated by cams 10 on corresponding camshafts 12. In the combustion chamber 6 there is also accommodated a reciprocating piston 14 which drives a crankshaft 16. The rotational energy of the crankshaft 16 is transmitted, at the axial end thereof, via drive element 18 to the camshaft adjuster 4. In the present example, the drive means may be a chain or a belt.

The camshaft adjusters 4 are mounted axially in each case on one of the camshafts 12, receive the rotational energy from the drive element 18 and transfer said rotational energy to the camshafts 12. Here, the camshaft adjusters 4 can temporarily slow or accelerate the rotation of the camshaft 12 relative to the crankshaft 14 in order to vary the phase relationship of the camshafts 12 relative to the crankshaft 16.

Figure 2:
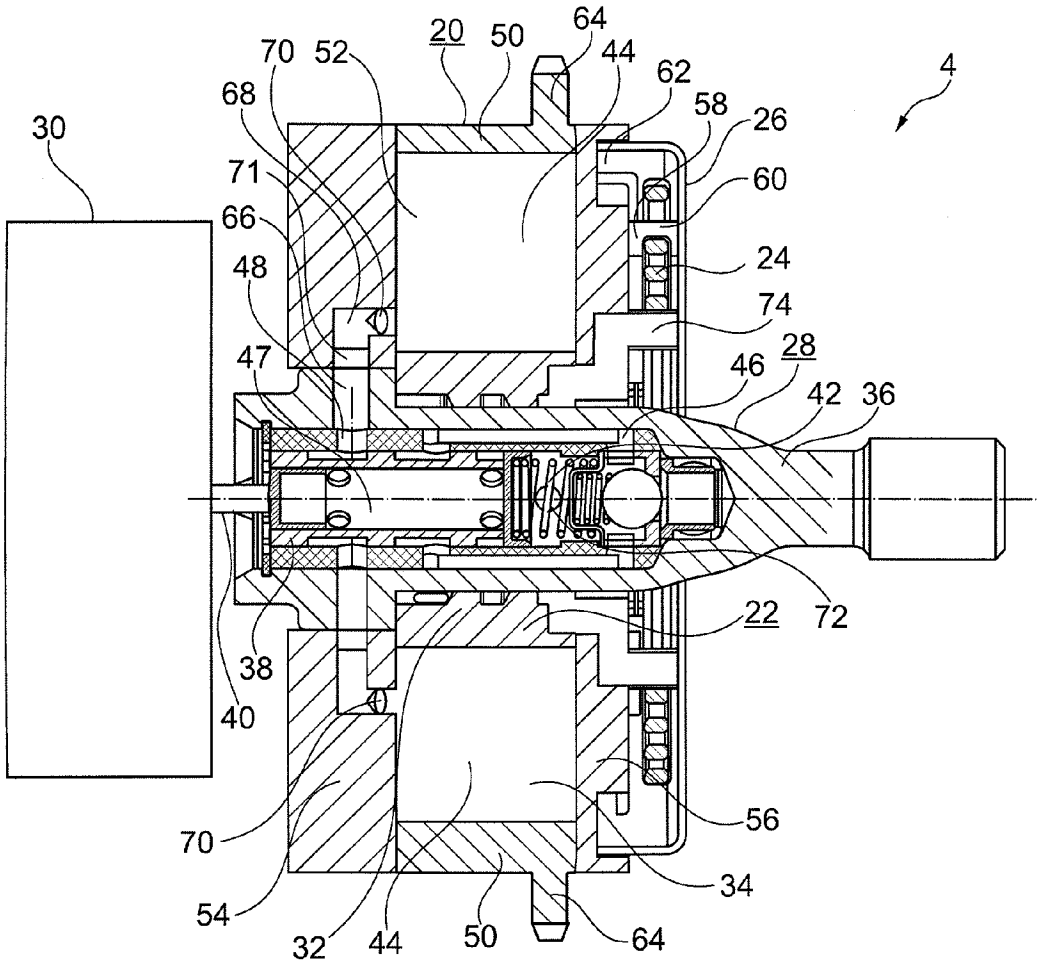
FIG. 2 shows a sectional view of a camshaft adjuster from FIG. 1 with a stator.

Reference is made to FIG. 2, which shows a sectional view of one of the camshaft adjusters 4 from FIG. 1 with a stator 20.

In addition to the stator 20, the camshaft adjuster 4 has a rotor 22 which is received in the stator 20, a spiral spring 24 which preloads the stator 20 relative to the rotor 22, and a spring cap 26 which covers the spiral spring.

The camshaft adjuster 4 is mounted centrally on a central valve 28 which is actuated by a central magnet 30.

Figure 3:
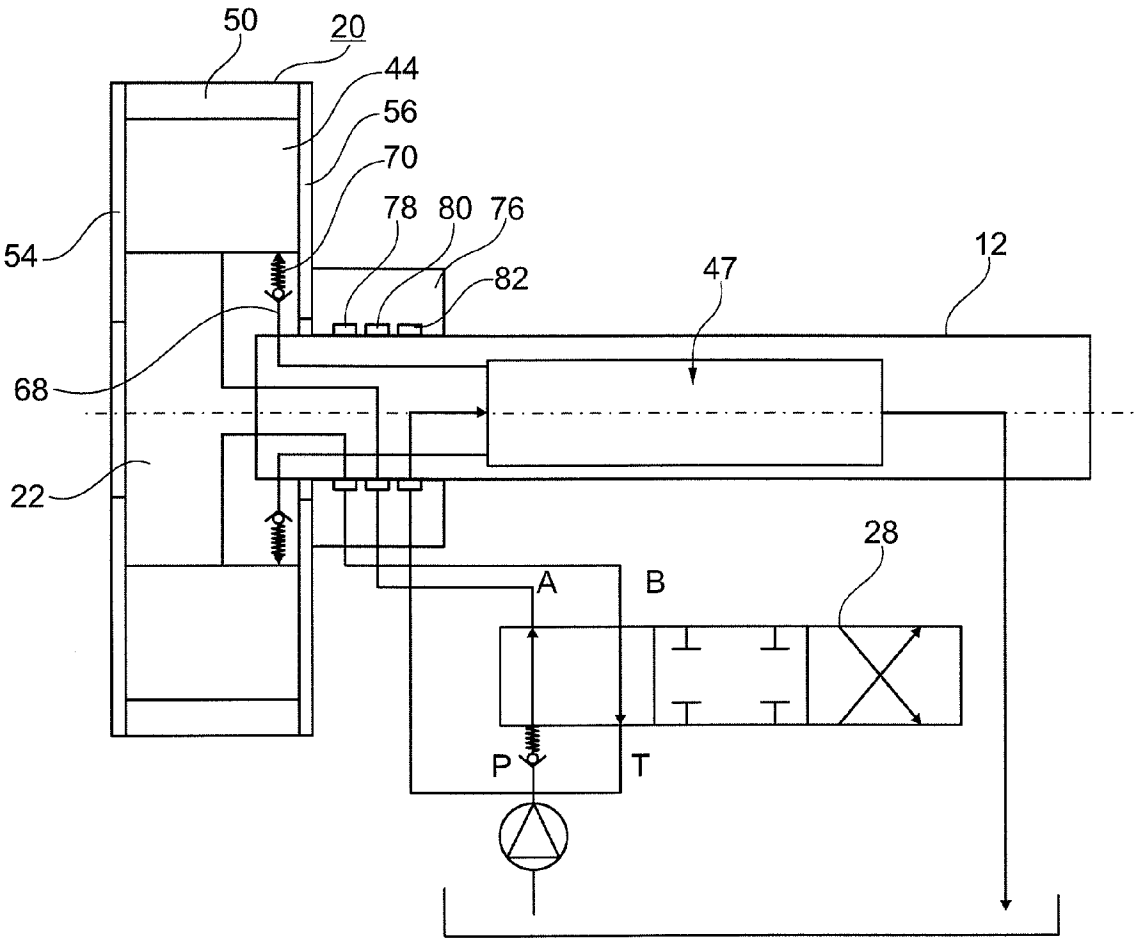
FIG. 3 is a schematic illustration of an internal combustion engine with a volume accumulator in the camshaft.
Figure 4:
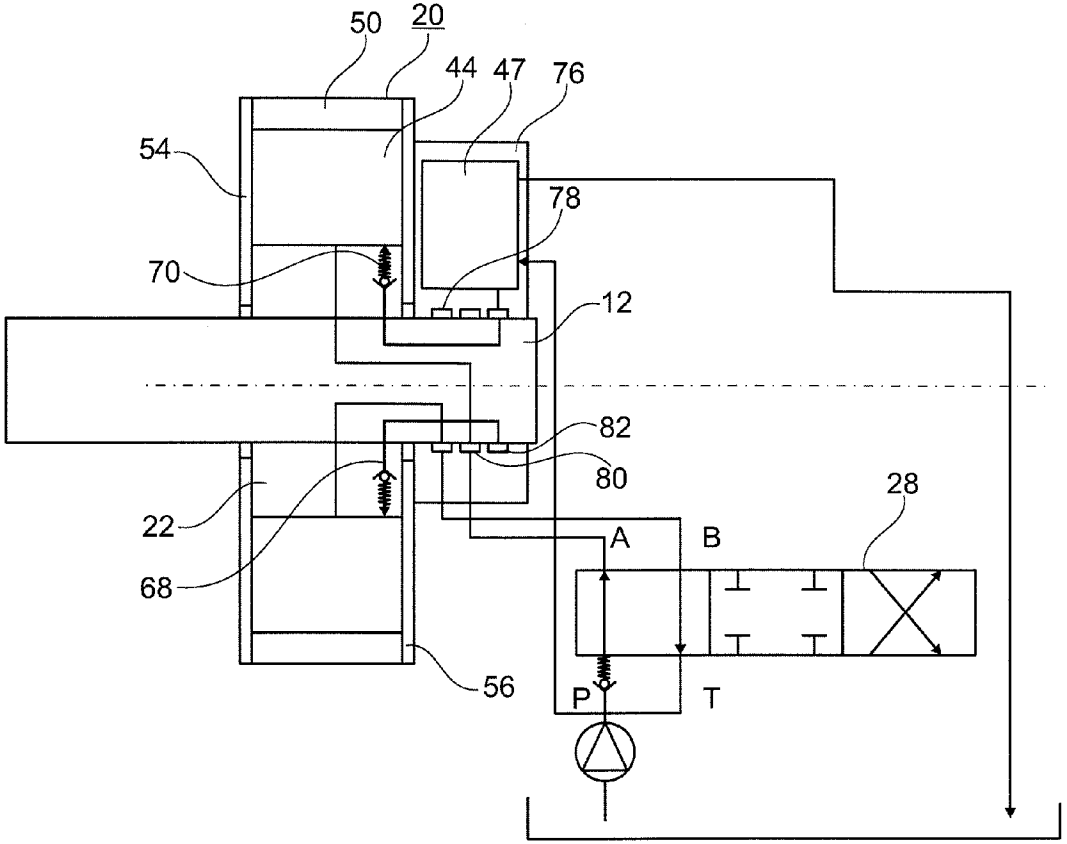
FIG. 4 is a schematic illustration of an internal combustion engine with a volume accumulator in the bearing bridge.
Figure 5:
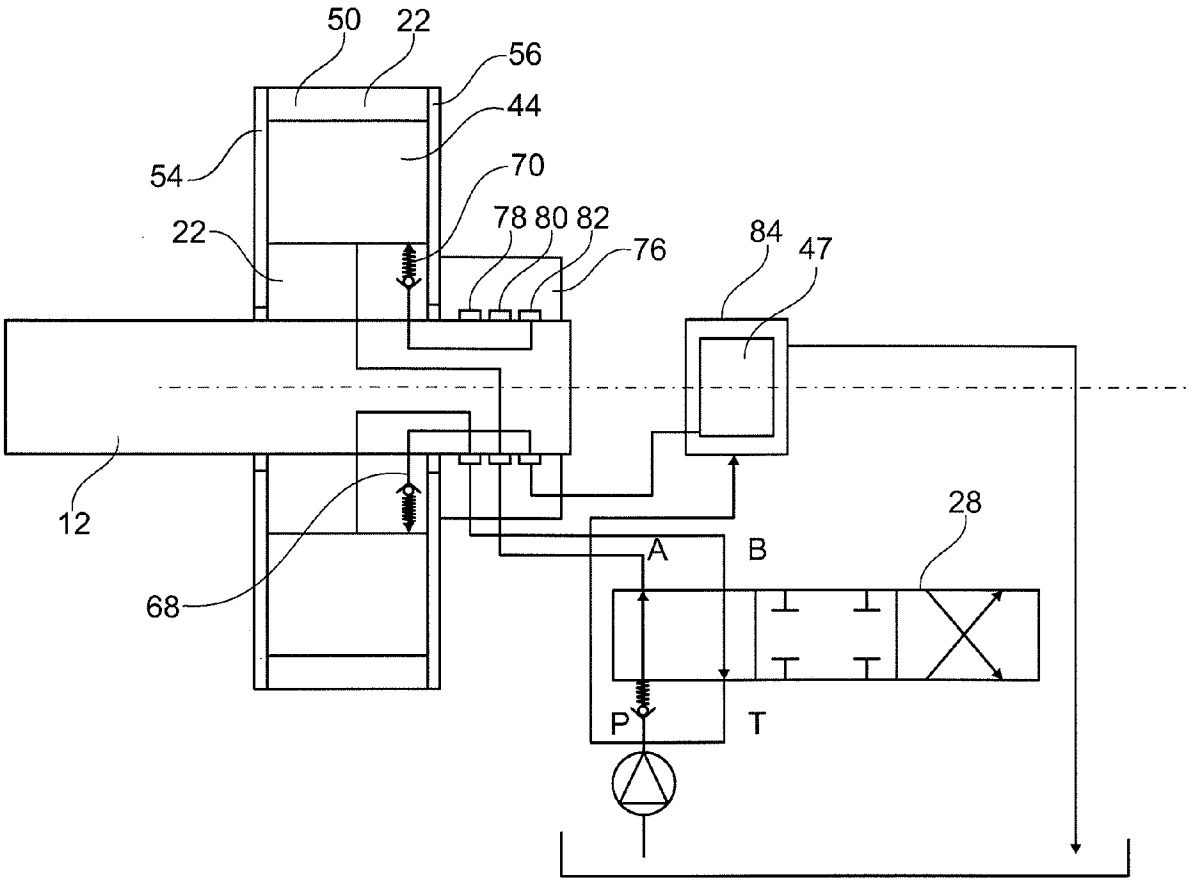
FIG. 5 is a schematic illustration of an internal combustion engine with a volume accumulator in the cylinder head.

The rotor 22 is received concentrically in the stator 20 and has vanes 34, shown in FIGS. 3 to 5, which project from a hub 32 of the rotor. The rotor 22 is held concentrically on a central screw 36, which can be screwed into one of the camshafts 12, of the central valve 28, in which central screw a control piston 38 is accommodated in an axially movable manner, which control piston can be moved axially into the central screw 36 by a plunger 40 of the central magnet and can be pushed axially out of the central screw 36 by a spring 42. Depending on the position of the control piston 38 in the central screw 36, pressure chambers 44 of the camshaft adjuster 4 are connected, in a manner known per se, to a pressure port 46 or to the interior of the central valve 28. The interior of the central valve 28 serves, in the present embodiment, as a volume accumulator 47 which temporarily stores the hydraulic liquid flowing out of the pressure chambers 44 before said hydraulic liquid flows out into a tank (not illustrated in any more detail). If a negative pressure is generated in the pressure chambers 44, the hydraulic liquid temporarily stored in the volume accumulator 47 can be drawn out by the pressure chambers 44 from a volume accumulator port 48 in order to compensate the negative pressure.

The stator 20 has an annular outer part 50 from which segments project radially inward in a manner known per se. The annular outer part 50 is closed off axially by a front cover 54 and a rear cover 56, wherein the covers 54, 56 are held on the annular outer part 50 by screws 58. One of the screws 58 has an axial elongation 60 which serves as a suspension point for the spiral spring 24. Furthermore, in the rear cover 56 on the axial side opposite the annular outer part 50, there is formed an encircling groove 62 in which the spring cover 26 is clamped. On the radial outer circumference of the annular outer part 50 there are formed teeth 64 which can engage into the drive element 18.

The central screw 36 has, as a volume accumulator port 48, a radial bore 66 on which is mounted an axial passage 68 through the front cover 54. The passage 68 is mounted radially on a circumferential groove 71 on the radially inner side, which is directed toward the central screw 36, of the front cover 54 in order to permit a flow of the hydraulic liquid between the radial bore 66 and the passage 68 in any position of the central screw 36, which is connected rotationally conjointly to the rotor 22, with respect to the stator 20.

The passage 68 leads into the pressure chambers 44 and is closed off by schematically illustrated check valves 70 which permit a flow of hydraulic liquid from the volume accumulator 47 into the pressure chambers 44 but not vice versa. In this way, a normally present positive pressure or ambient pressure in the pressure chambers 44 is prevented from being compensated by means of the volume accumulator 47.

The volume accumulator 47 is furthermore connected, in a manner which is not illustrated in any more detail, via a radial bore 72 at the level of the spring 42 to a tank port 74 via which excess hydraulic liquid can flow out into the tank.

In the present embodiment, the volume accumulator 47 is accommodated outside the camshaft adjuster 4 in the central valve 28. Below, further possibilities in the internal combustion engine 2 as regards where the volume accumulator 47 can be accommodated outside the camshaft adjuster 4 will be presented on the basis of schematic illustrations.

Reference is made to FIG. 3. In FIG. 3, the volume accumulator 47 is accommodated in the camhaft 12.

In the present embodiment, the camshaft adjuster 47 has a schematically illustrated rotary transmitter 76 with three interfaces 78, 80, 82. The rotary transmitter 76 furthermore serves as a bearing bridge for the radial and if appropriate also axial mounting of the camshaft 12. Whereas the first and the second interface 78, 80 are provided in each case for the supply of the hydraulic liquid to and the discharge of the hydraulic liquid from the pressure chambers 44, hydraulic liquid discharged from the pressure chambers 44 is conducted via the third interface 82 to the volume accumulator 47 and back to the pressure chambers 44. These pressure chambers can draw the hydraulic liquid in in the manner described above if a negative pressure occurs.

As a result of the arrangement or integration of the volume accumulator 47 in the camshaft, the installation space of the camshaft adjuster 4 can be maintained, and a cavity which is present in any case in many camshaft designs can be put to beneficial use. Furthermore, the hydraulic liquid is temporarily stored close to the axis of rotation of the camshaft, which minimizes the centrifugal forces arising from the rotation of the overall system composed of camshaft adjuster 4, central valve 28 and camshaft 12.

Reference is made to FIG. 4. In FIG. 4, the volume accumulator 47 is integrated in the rotary transmitter 76, that is to say in the bearing bridge.

The volume accumulator 47 can in many cases be more easily integrated in the bearing bridge because the bearing bridge is subject to fewer installation space restrictions than the camshaft adjuster 4. Furthermore, as a result of the integration of the volume accumulator 47, no centrifugal forces act on the hydraulic liquid temporarily stored in the volume accumulator 47 during the operation of the camshaft adjuster 4, because the bearing bridge is a static component. This reduces the mechanical loading on the components of the internal combustion engine 2.

Alternatively, the volume accumulator 4 may also be accommodated, as shown in FIG. 5, in any other component of the internal combustion engine 2, for example a cylinder head 84.

Figure 6:
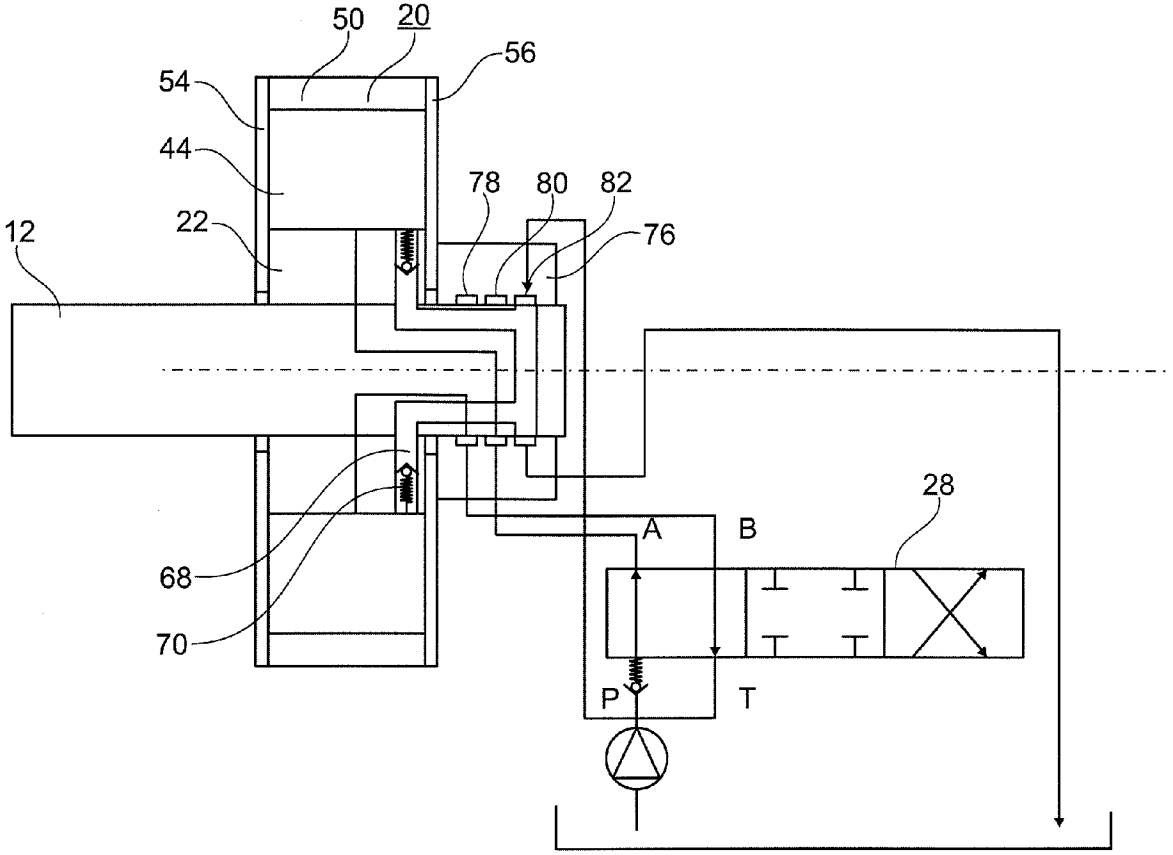
FIG. 6 shows a schematic illustration of an internal combustion engine having a volume accumulator in the hydraulic lines.

As yet a further alternative, the volume accumulator 4 may also be integrated, as shown in FIG. 6, in the passage 68 via which the pressure chambers 44 draw in hydraulic liquid in the event of a negative pressure. This passage would then have to be of correspondingly voluminous design.

LIST OF REFERENCE NUMERALS

2 Internal combustion engine
4 Camshaft adjuster
6 Combustion chamber
8 Valve
10 Cam
12 Camshaft
14 Reciprocating piston
16 Crankshaft
18 Drive mechanism
20 Stator
22 Rotor
24 Spiral spring
26 Spring cap
28 Central valve
30 Central magnet
32 Hub
34 Vane
36 Central screw
38 Control piston
40 Plunger
42 Spring
44 Pressure chamber
46 Pressure port
47 Volume accumulator
48 Volume accumulator port
50 Annular outer part
52 Segment
54 Front cover
56 Rear cover
58 Screw
60 Axial elongation
62 Groove
64 Tooth
66 Radial bore
68 Duct
70 Check valve
72 Bore
74 Tank port
76 Rotary transmitter
78 Interface
80 Interface
82 Interface
84 Cylinder head

The invention claimed is:

1. A camshaft adjuster comprising a stator and a rotor which is received in the stator and which can be rotated relative to the stator via a pressure chamber, a pressure interface for supplying of a hydraulic liquid to the pressure chamber, an outflow interface for discharge of the hydraulic liquid from the pressure chamber, a third interface for filling the pressure chamber with hydraulic liquid from a volume accumulator, and the pressure interface, the outflow interface, and the third interface are formed as rotary interfaces on a radial surface of a fixed rotary transmitter.

2. The camshaft adjuster as claimed in claim 1, wherein the pressure interface, the outflow interface, and the third interface are formed on a radially inner surface of the rotary transmitter.

3. The camshaft adjuster as claimed in claim 1, comprising a passage between the third interface and the pressure chamber.

4. The camshaft adjuster as claimed in claim 3, wherein the passage is closed off by a check valve which blocks a flow of hydraulic liquid from the pressure chamber into the third interface.

5. The camshaft adjuster as claimed in claim 4, comprising an additional passage between the pressure interface and the pressure chamber, the passage has a greater volume than the additional passage.

6. An internal combustion engine comprising a combustion chamber, a crankshaft which is driven by the combustion chamber, and a camshaft which controls the combustion chamber, and a camshaft adjuster as claimed in claim 1 for transmitting rotational energy from the crankshaft to the camshaft, and a volume accumulator connected to and arranged outside of the camshaft adjuster.

7. The internal combustion engine as claimed in claim 6, wherein the volume accumulator is arranged in the camshaft.

8. The internal combustion engine as claimed in claim 7, wherein a central valve in which the volume accumulator is formed is accommodated in the camshaft.

9. The internal combustion engine as claimed in claim 6, comprising a cylinder head in which the volume accumulator is arranged.

10. The internal combustion engine as claimed in claim 6, comprising a bearing bridge in which the volume accumulator is arranged.

* * * * *